US008432336B2

(12) United States Patent
Yoo

(10) Patent No.: US 8,432,336 B2
(45) Date of Patent: Apr. 30, 2013

(54) PIXEL AND ORGANIC LIGHT EMITTING DISPLAY DEVICE USING THE SAME

(75) Inventor: Myoung-Hwan Yoo, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 223 days.

(21) Appl. No.: 12/870,655

(22) Filed: Aug. 27, 2010

(65) Prior Publication Data

US 2011/0156990 A1 Jun. 30, 2011

(30) Foreign Application Priority Data

Dec. 31, 2009 (KR) ..... 10-2009-0135197

(51) Int. Cl.
*G09G 3/30* (2006.01)
*G09G 5/00* (2006.01)

(52) U.S. Cl.
USPC ..... 345/76; 345/211

(58) Field of Classification Search ..... 345/207, 345/211, 76, 212, 204, 77
See application file for complete search history.

(56) References Cited

U.S. PATENT DOCUMENTS

2008/0290805 A1* 11/2008 Yamada et al. ..... 315/169.1
2010/0033510 A1* 2/2010 Handa et al. ..... 345/690

FOREIGN PATENT DOCUMENTS

JP 2008-026467 2/2008
KR 10-2006-0113334 A 11/2006
KR 10-2007-0112714 A 11/2007
KR 1020070118857 A 12/2007
KR 1020080082118 A 9/2008
KR 1020090046053 A 5/2009
KR 1020090095913 A 9/2009

OTHER PUBLICATIONS

KIPO Office action dated Jul. 28, 2011, for Korean priority Patent application No. 10-2009-0135197, 1 page.

* cited by examiner

*Primary Examiner* — Michael Faragalla
(74) *Attorney, Agent, or Firm* — Christie, Parker & Hale, LLP

(57) ABSTRACT

A pixel for use in an organic light emitting display device capable of displaying an image of uniform brightness is provided. The pixel includes: an organic light emitting diode; a first transistor for controlling the amount of current supplied to the organic light emitting diode; a storage capacitor coupled between a gate electrode and a second electrode of the first transistor; a second transistor coupled between the gate electrode of the first transistor and a data line, and configured to turn on when a scan signal is supplied to a scan line; a fourth transistor coupled between the first electrode of the first transistor and a first power source, and configured to be off during a period when a voltage is charged to the storage capacitor; and a third transistor coupled between the gate electrode and the first electrode of the first transistor.

17 Claims, 5 Drawing Sheets

PIXEL AND ORGANIC LIGHT EMITTING DISPLAY DEVICE USING THE SAME

CROSS-REFERENCE TO RELATED APPLICATION(S)

This application claims priority to and the benefit of Korean Patent Application No. 10-2009-0135197, filed in the Korean Intellectual Property Office on Dec. 31, 2009, the entire content of which is incorporated herein by reference.

BACKGROUND

1. Field

Aspects of embodiments according to the present invention relate to a pixel and an organic light emitting display device using the same.

2. Description of the Related Art

Recently, various thin and lightweight flat panel display devices (compared to cathode ray tube devices) have been developed. These include liquid crystal displays (LCDs), field emission displays (FEDs), plasma display panels (PDPs), and organic light emitting display devices. The organic light emitting display devices use organic light emitting diodes for emitting light when electrons and holes are re-combined, and have rapid response and low power consumption.

FIG. 1 is a circuit diagram illustrating a pixel of a conventional organic light emitting display device with NMOS transistors.

Referring to FIG. 1, a pixel 4 of a conventional organic light emitting display device includes an organic light emitting diode OLED and a pixel circuit 2. The pixel circuit 2 is connected to a data line Dm and a scan line Sn, and controls the organic light emitting diode OLED.

An anode electrode of the OLED is connected to the pixel circuit 2 and a cathode electrode of the OLED is connected to a second power source ELVSS. The OLED generates light of a particular brightness (e.g., a predetermined brightness) in response to current supplied from the pixel circuit 2.

The pixel circuit 2 controls the amount of current supplied to the OLED in response to a data signal. The data signal is supplied to the data line Dm when the scan signal is supplied to the scan line Sn. The pixel circuit 2 includes a second transistor M2 (that is, a driving transistor) connected between a first power source ELVDD and the OLED; a first transistor M1 connected between the second transistor M2 and the data line Dm, and driven by the scan line Sn; and a storage capacitor Cst connected between a gate electrode and a second electrode of the second transistor M2.

A gate electrode of the first transistor M1 is connected to the scan line Sn and a first electrode of the first transistor M1 is connected to the data line Dm. A second electrode of the first transistor M1 is connected to a first terminal of the storage capacitor Cst. Here, the first electrode is set to one of a source electrode and a drain electrode and the second electrode is set to the other electrode. For example, when the first electrode is set to a drain electrode, the second electrode is set to a source electrode. The first transistor M1 is connected to the data line Dm and is turned on when a scan signal is supplied from the scan line Sn. When turned on, the first transistor transfers a data signal from the data line Dm to the storage capacitor Cst. At this time, the storage capacitor Cst charges a voltage corresponding to the data signal.

The gate electrode of the second transistor M2 is connected to the first terminal of the storage capacitor Cst and a first electrode of the second transistor M2 is connected to the first power source ELVDD. The second electrode of the second transistor M2 is connected to a second terminal of the storage capacitor Cst and the anode electrode of the OLED. The second transistor M2 controls the amount of current flowing from the first power source ELVDD to the second power source ELVSS via the OLED in response to a voltage value stored in the storage capacitor Cst.

The first terminal of the storage capacitor Cst is connected to the gate electrode of the second transistor M2 and the second terminal of the storage capacitor Cst is connected to the anode electrode of the OLED. The storage capacitor Cst charges a voltage corresponding to the data signal.

The conventional pixel 4 displays an image of a particular brightness (e.g., a predetermined brightness) by supplying current corresponding to the voltage charged to the storage capacitor Cst to the OLED. However, the conventional organic light emitting display device cannot display an image of a uniform brightness due to a variation in threshold voltages of the second transistors M2 of the different pixels.

In a conventional organic light emitting display device, when different pixels have different threshold voltages of the second transistors M2, the respective pixels 4 generate light of different brightness in response to the same data signal. Thus, images of uniform brightness cannot be displayed.

SUMMARY

Accordingly, aspects of embodiments according to the present invention provide for a pixel for use in an organic light emitting display device capable of displaying an image of uniform brightness, and an organic light emitting display device using the pixel.

In an exemplary embodiment according to the present invention, a pixel is provided. The pixel includes an organic light emitting diode, a first transistor, a second transistor, a third transistor, a storage capacitor, and a fourth transistor. The first transistor is for controlling the amount of current supplied to the organic light emitting diode. The storage capacitor is coupled between a gate electrode and a second electrode of the first transistor. The second transistor is coupled between the gate electrode of the first transistor and a data line, and is configured to turn on when a scan signal is supplied to a scan line. The fourth transistor is coupled between the first electrode of the first transistor and a first power source, and is configured to be off during a period when a voltage is charged to the storage capacitor. The third transistor is coupled between the gate electrode and the first electrode of the first transistor, and is configured to be on for a part of a period when the fourth transistor is turned on.

The second transistor and the third transistor may be configured to turn on at a same time.

The second transistor may be configured to maintain a turn-on state for a time longer than that of the third transistor.

The data line may be configured to: receive a voltage of a reference power source during a period when the second transistor and the third transistor are turned on at the same time, and receive a data signal for a period when the second transistor only maintains the turn-on state.

The fourth transistor may be configured to maintain a turn-off state for a period when the second transistor and the third transistor are turned on.

The pixel may further include a fifth transistor. The fifth transistor is coupled between the gate electrode of the first transistor and a reference power source, and is configured to turn on and off concurrently with the third transistor.

The second transistor may be further configured to turn on after: the third transistor and the fifth transistor are turned on, and a voltage corresponding to a threshold voltage of the first transistor is charged to the storage capacitor.

The pixel may further include a sixth transistor. The sixth transistor is coupled between the second electrode of the first transistor and the organic light emitting diode, and is configured to turn on and off concurrently with the fourth transistor.

In another exemplary embodiment according to the present invention, an organic light emitting display device is provided. The organic light emitting display device includes a scan driving unit, a control line driving unit, a data driving unit, and a pixel. The scan driving unit is for supplying scan signals to scan lines in a first direction, and for supplying light emitting control signals to light emitting control lines in the first direction. The control line driving unit is for supplying control signals to control lines in the first direction. The data driving unit is for supplying data signals to data lines in a second direction that crosses the first direction, in synchronization with the scan signals. The pixel is positioned at an ith (i is a natural number) line in the first direction and a jth (j is a natural number) line in the second direction. The pixel includes an organic light emitting diode, a first transistor, a second transistor, a third transistor, a storage capacitor, and a fourth transistor. The first transistor is for controlling the amount of current supplied to the organic light emitting diode. The storage capacitor is coupled between a gate electrode and a second electrode of the first transistor. The second transistor is coupled between the gate electrode of the first transistor and a jth data line of the data lines, and is configured to turn on when a scan signal of the scan signals is supplied to an ith scan line of the scan lines. The third transistor is coupled between the gate electrode and a first electrode of the first transistor, and is configured to turn on when a control signal of the control signals is supplied to an ith control line of the control lines. The fourth transistor is coupled between the first electrode of the first transistor and a first power source, and is configured to: turn off when a light emitting control signal of the light emitting control signals is supplied to an ith light emitting control line of the light emitting control lines, and turn on when the light emitting control signal is not supplied.

The scan signal may be set to a wider width than the control signal. The control signal and the scan signal may be supplied at a same time.

The light emitting control signal may overlap the control signal and the scan signal.

The data driving unit may be configured to: supply a voltage of a reference power source to the jth data line for a period when the control signal is supplied, and supply a data signal of the data signals to the jth data line for a period when the control signal is not supplied and the scan signal is supplied.

The voltage of the reference power source is set to a voltage higher than a threshold voltage of the organic light emitting diode.

The organic light emitting display device may further include a fifth transistor. The fifth transistor is coupled between the gate electrode of the first transistor and a reference power source, and is configured to turn on and off concurrently with the third transistor.

The scan signal may be supplied after the control signal is supplied.

The light emitting control signal may overlap the control signal and the scan signal.

The organic light emitting display device may further include a sixth transistor. The sixth transistor is coupled between the second electrode of the first transistor and the organic light emitting diode, and is configured to: turn off when the light emitting control signal is supplied, and turn on when the light emitting control signal is not supplied.

According to embodiments of the pixel and the organic light emitting display using the same of the present invention, an image of uniform brightness may be displayed regardless of the threshold voltages of the driving transistors.

BRIEF DESCRIPTION OF THE DRAWINGS

The accompanying drawings, together with the specification, illustrate exemplary embodiments of the present invention, and, together with the description, serve to explain the principles of embodiments of the present invention.

DETAILED DESCRIPTION

Figure 1:
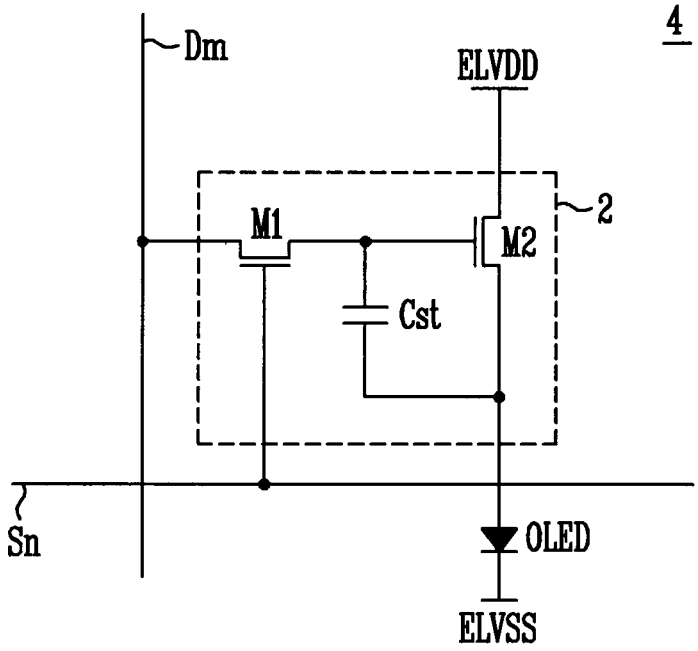
FIG. 1 is a circuit diagram illustrating a conventional pixel.

Hereinafter, certain exemplary embodiments according to the present invention will be described with reference to the accompanying drawings. Here, when a first element is described as being "coupled" to a second element, the first element may be not only directly coupled (e.g., connected) to the second element but may also be indirectly coupled (e.g., electrically coupled) to the second element via one or more third elements. Further, some of the elements that are not essential to the complete understanding of the invention are omitted for clarity. Also, like reference numerals refer to like elements throughout.

Hereinafter, the embodiments of the present invention will be described such that those skilled in the art can easily practice the present invention in detail with reference to FIGS. 2 to 7.

Figure 2:
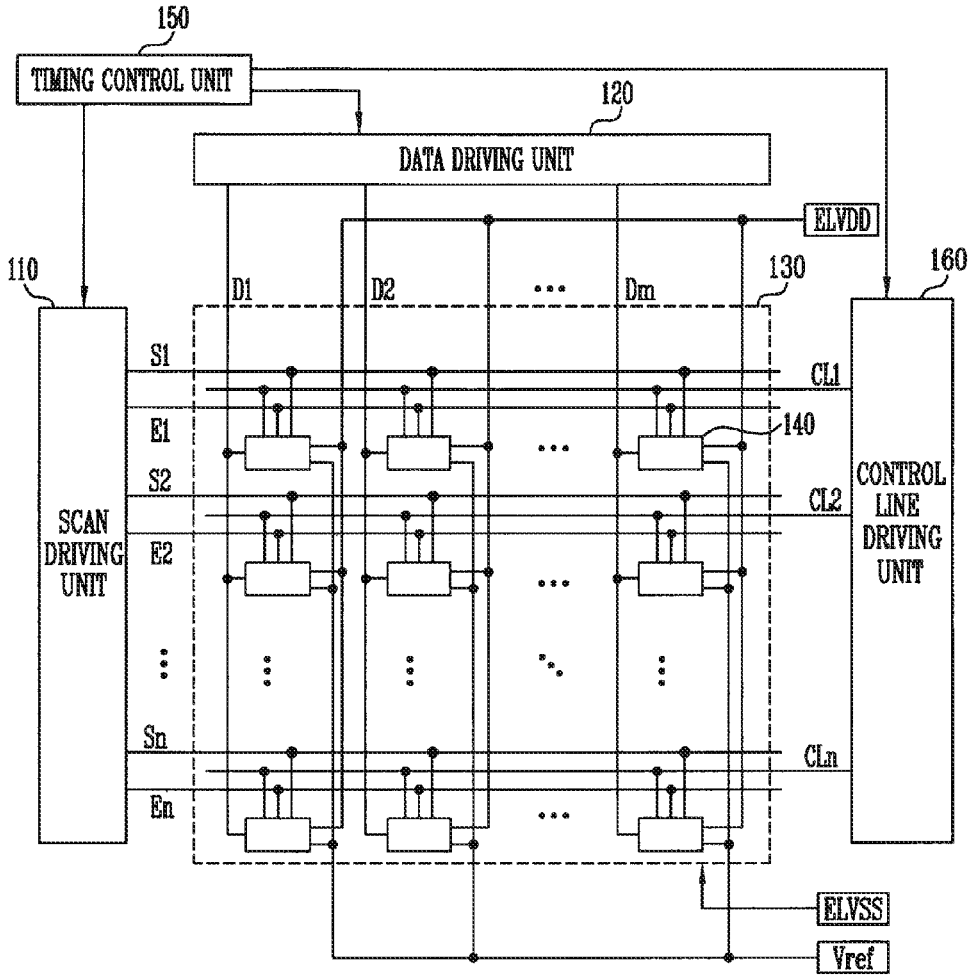
FIG. 2 is a view illustrating an organic light emitting display device according to an embodiment of the present invention.

FIG. 2 is a view illustrating an organic light emitting display device according to an embodiment of the present invention.

Referring to FIG. 2, the organic light emitting display device includes a display unit 130 including pixels 140 that are positioned at crossing regions of scan lines S1 to Sn, light emitting control lines E1 to En, control lines CL1 to CLn, and data lines D1 to Dm. The pixels 140 are arranged in a matrix form. The display device also includes a scan driving unit 110 for driving the scan lines S1 to Sn and the light emitting control lines E1 to En, a data driving unit 120 for driving the data lines D1 to Dm, a control line driving unit 160 for driving the control lines CL1 to CLn, and a timing control unit 150 for controlling the scan driving unit 110, the data driving unit 120, and the control line driving unit 160.

The control line driving unit 160 sequentially supplies control signals to the control lines CL1 to CLn. The control signal supplied to an ith (i is a natural number) control line CLi is supplied before a scan signal is supplied to an ith scan line Si. While supplying the control signals, each of the pixels 140 charges a voltage corresponding to a threshold voltage of its driving transistor.

The scan driving unit 110 sequentially supplies the scan signals to the scan lines S1 to Sn and light emitting control signals to the light emitting control lines E1 to En. Here, the light emitting control signal supplied to an ith light emitting control line E1 overlaps the control signal supplied to the ith control line CLi and the scan signal supplied to the ith scan line Si.

The scan signal is set to a voltage that turns on the transistors included in the pixel 140, and the light emitting control signal is set to a voltage that turns off the transistors included in the pixel 140. For example, the scan signal may be set to a high-level voltage and the light emitting control signal may be set to a low-level voltage that is lower than the high-level voltage.

The data driving unit 120 supplies the data signals to the data lines D1 to Dm in synchronization with the scan signals supplied to the scan lines S1 to Sn.

The timing control unit 150 controls the scan driving unit 110, the data driving unit 120, and the control driving unit 160 in response to a synchronizing signal supplied from the exterior.

The display unit 130 includes the pixels 140 formed at crossing regions of the scan lines S1 to Sn and the data lines D1 to Dm. The pixels 140 are coupled to a first power source ELVDD, a second power source ELVSS, and a reference power source Vref from the exterior. Each of the pixels 140 receives the reference power source Vref and controls the amount of current flowing from the first power source ELVDD to the second power source ELVSS via the organic light emitting diode (not shown) in response to a voltage difference between the reference power source and the data signal. To this end, each of the pixels 140 includes a plurality of NMOS transistors and a plurality of organic light emitting diodes.

Figure 3:
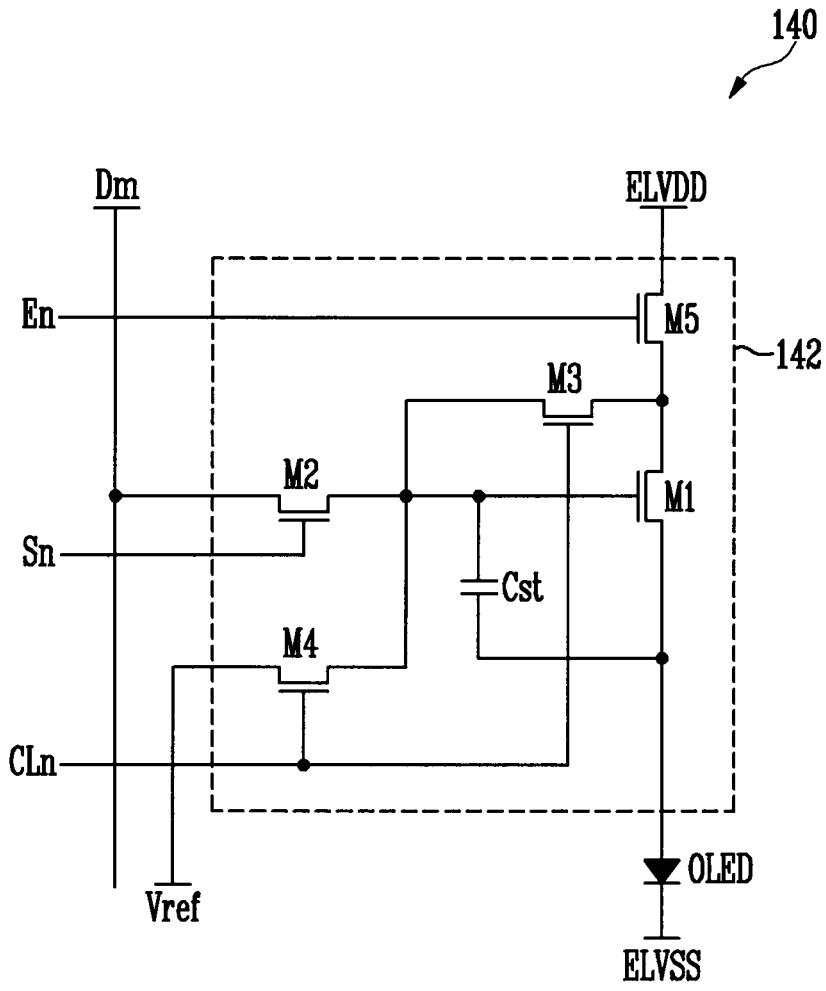
FIG. 3 is a circuit diagram illustrating a first embodiment of the pixel as shown in FIG. 2.

FIG. 3 is a circuit diagram illustrating a pixel according to a first embodiment of the present invention. For convenience of description, FIG. 3 shows the pixel 140 coupled to an nth scan line Sn, an nth light emitting control line En, an nth control line CLn, and an mth data line Dm.

Referring to FIG. 3, the pixel 140 includes a pixel circuit 142, which is coupled to an organic light emitting diode (OLED), the data line Dm, the scan line Sn, and the light emitting control line En, for controlling the OLED.

An anode electrode of the OLED is coupled to the pixel circuit 142 and a cathode electrode of the OLED is coupled to the second power source ELVSS. The OLED generates light of a particular brightness (e.g., a predetermined brightness) in response to current supplied from the pixel circuit 142.

The pixel circuit 142 charges a voltage corresponding to a threshold voltage of the first transistor M1 during the supply of the control signal to the control line CLn, and charges a voltage corresponding to the data signal during the supply of the scan signal to the scan line Sn. The pixel circuit 142 includes first to fifth transistors M1 to M5 and a storage capacitor Cst.

A first electrode of the first transistor M1 is coupled to a second electrode of the fifth transistor M5 and a second electrode of the first transistor M1 is coupled to the anode electrode of the OLED. A gate electrode of the first transistor M1 is coupled to a first terminal of the storage capacitor Cst. The first transistor M1 controls the amount of current flowing from the first power source ELVDD to the second power source ELVSS via the OLED in response to a voltage applied to the gate electrode of the first transistor M1.

A first electrode of the second transistor M2 is coupled to the data line Dm and a second electrode of the second transistor M2 is coupled to the gate electrode of the first transistor M1. A gate electrode of the second transistor M2 is coupled to the scan line Sn. The second transistor M2 is turned on when the scan signal is supplied to the scan line Sn, and electrically connects the data line Dm to the gate electrode of the first transistor M1.

A first electrode of the third transistor M3 is coupled to the first electrode of the first transistor M1 and a second electrode of the third transistor M3 is coupled to the gate electrode of the first transistor M1. A gate electrode of the third transistor M3 is coupled to the control line CLn. The third transistor M3 is turned on when the control signal is supplied to the control line CLn, and diode-connects the first transistor M1.

A first electrode of the fourth transistor M4 is coupled to the gate electrode of the first transistor M1 and a second electrode of the fourth transistor M4 is coupled to the reference power source Vref. A gate electrode of the fourth transistor M4 is coupled to the control line CLn. The fourth transistor M4 is turned on when the control signal is supplied to the control line CLn, and supplies a voltage of the reference power source Vref to the gate electrode of the first transistor M1.

A first electrode of the fifth transistor M5 is coupled to the first power source ELVDD and the second electrode of the fifth transistor M5 is coupled to the first electrode of the first transistor M1. A gate electrode of the fifth transistor M5 is coupled to the light emitting control line En. The fifth transistor M5 is turned off when the light emitting control signal is supplied to the light emitting control line En and is turned on when the light emitting control signal is not supplied to the light emitting control line En.

The storage capacitor Cst is coupled between the gate electrode of the first transistor and the second electrode of the first transistor M1. The storage capacitor Cst charges a voltage corresponding to the data signal and the threshold voltage of the first transistor M1.

Figure 4:
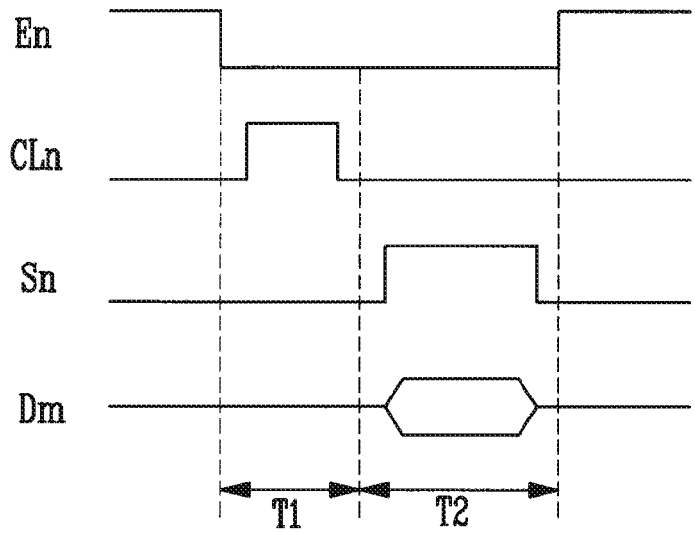
FIG. 4 is a waveform chart illustrating a driving method of the pixel of FIG. 3.

FIG. 4 is a waveform chart illustrating a driving method of the pixel of FIG. 3.

For convenience of description of FIG. 4, driving processes will be described for a first period T1 and a second period T2. The first period T1 refers to a period when the control signal is supplied to the control line CLn while the second period T2 refers to a period when the scan signal is supplied to the scan line Sn (after stopping the supply of the control signal to the control line CLn). The light emitting control signal supplied to the light emitting control line En is supplied during the first period T1 and the second period T2.

Referring to FIG. 4, first, the light emitting control signal is supplied to the light emitting control line En and the control signal is supplied to the control line CLn. When the light emitting control signal is supplied to the light emitting control line En, the fifth transistor M5 is turned off. When the fifth transistor M5 is turned off, the first transistor M1 and the first power source ELVDD are electrically separated from each other.

When the control signal is supplied to the control line CLn, the third transistor M3 and the fourth transistor M4 are turned on. When the third transistor M3 is turned on, the first transistor M1 is diode-connected. When the fourth transistor M4 is turned on, the voltage of the reference power source Vref is supplied to the gate electrode of the first transistor M1.

Since the first transistor M1 is diode-connected, a voltage (in which the threshold voltage of the first transistor M1 is subtracted from the voltage of the reference power source Vref) is applied to the second electrode of the first transistor M1. Accordingly, the voltage of the reference power source Vref is set to a voltage higher than the threshold voltage of the OLED. During the first period T1, the storage capacitor Cst charges a voltage corresponding to the threshold voltage of the first transistor M1.

During the second period T2, the supply of the control signal to the control line CLn is stopped and the scan signal is supplied to the scan line Sn. When the supply of the control signal to the control line CLn is stopped, the third transistor M3 and the fourth transistor M4 are turned off. When the scan signal is supplied to the scan line Sn, the second transistor M2 is turned on.

When the second transistor M2 is turned on, the data signal is supplied from the data line Dm to the gate electrode of the first transistor M1 via the second transistor M2. At this time, the storage capacitor Cst charges a voltage corresponding to the data signal.

When the data signal is supplied to the gate electrode of the first transistor M1, the voltage between the gate electrode and the source electrode of the first transistor M1 is ideally set by equation 1:

$$Vgs(M1)=Vdata-(Vref-Vth) \quad \text{Equation 1}$$

where Vdata refers to the voltage of the data signal and Vth refers to the threshold voltage of the first transistor M1.

After the second period T2, the supply of the scan signal to the scan line Sn and the supply of the light emitting control signal to the light emitting control signal En are stopped. When the supply of the scan signal to the scan line Sn is stopped, the second transistor M2 is turned off. When the supply of the light emitting control signal to the light emitting control line En is stopped, the fifth transistor M5 is turned on. When the fifth transistor M5 is turned on, the first power source ELVDD and the first electrode of the first transistor M1 are electrically connected.

At this time, the first transistor M1 supplies current corresponding to equation 2 to the OLED:

$$\begin{aligned} Ioled &= \beta(Vgs(M1) - Vth(M1))^2 \quad \text{Equation 2} \\ &= \beta\{(Vdata - Vref + Vth) - Vth(M1)\}^2 \\ &= \beta(Vdata - Vref)^2 \end{aligned}$$

Referring to equation 2, the current flowing to the OLED is determined by a voltage difference between the voltage Vdata of the data signal and that of the reference power source Vref. Since the reference power source is a fixed voltage, the current flowing through the OLED is determined by the voltage Vdata of the data signal. As expressed by equation 2, the present invention may display an image of uniform brightness regardless of the threshold voltage of the first transistor M1, or the variation of threshold voltages of first transistors M1 of different pixels.

Figure 5:
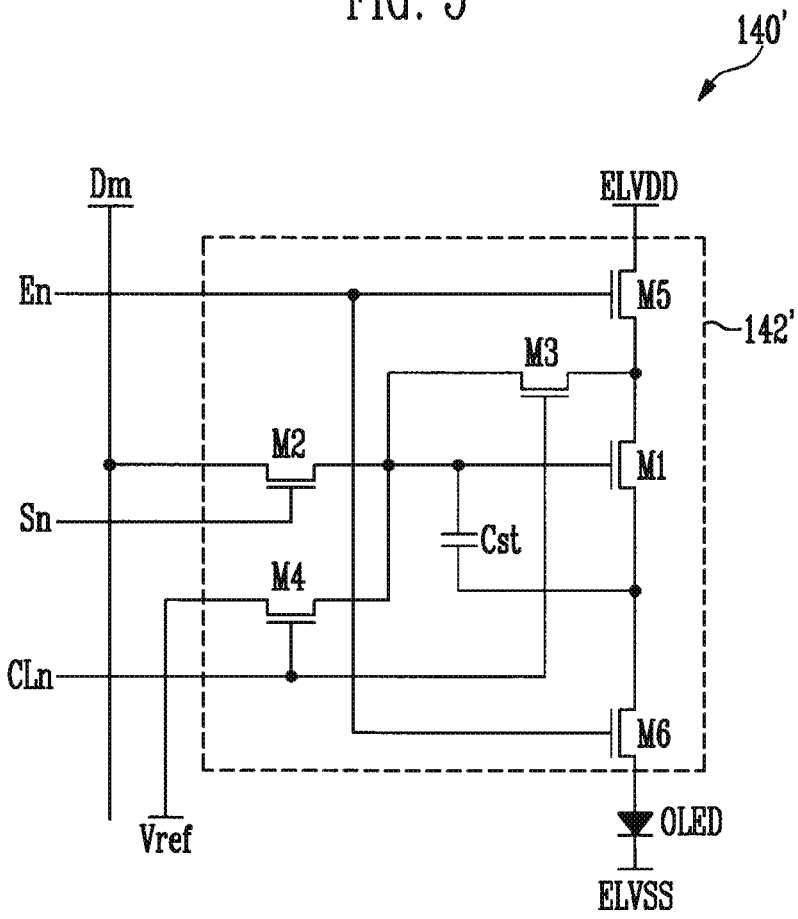
FIG. 5 is a circuit diagram illustrating a second embodiment of the pixel of FIG. 2.

FIG. 5 is a circuit diagram illustrating a pixel according to a second embodiment of the present invention. In the description of FIG. 5, like elements as FIG. 3 will be assigned with like reference numerals and their description will not be repeated.

Referring to FIG. 5, the pixel 140' includes an OLED and a pixel circuit 142' for controlling the amount of current to be supplied to the OLED.

The pixel circuit 142' further includes a sixth transistor M6 coupled between the second electrode of the first transistor M1 and the OLED. The sixth transistor M6 is turned off when the light emitting control signal is supplied to the light emitting control line En.

That is, the sixth transistor M6 is turned off for a period when the control signal and the scan signal are supplied to the control line CLn and the scan line Sn, respectively. In this case, the voltage of the second electrode of the first transistor M1 may be set to a voltage in which the threshold voltage of the first transistor M1 is subtracted from the reference power source Vref regardless of the threshold voltage of the OLED during the period when the voltage of the reference power source Vref is supplied to the gate electrode of the first transistor M1. That is, in the pixel 140', the threshold voltage of the first transistor M1 may be compensated regardless of the voltage applied to the OLED.

Figure 6:
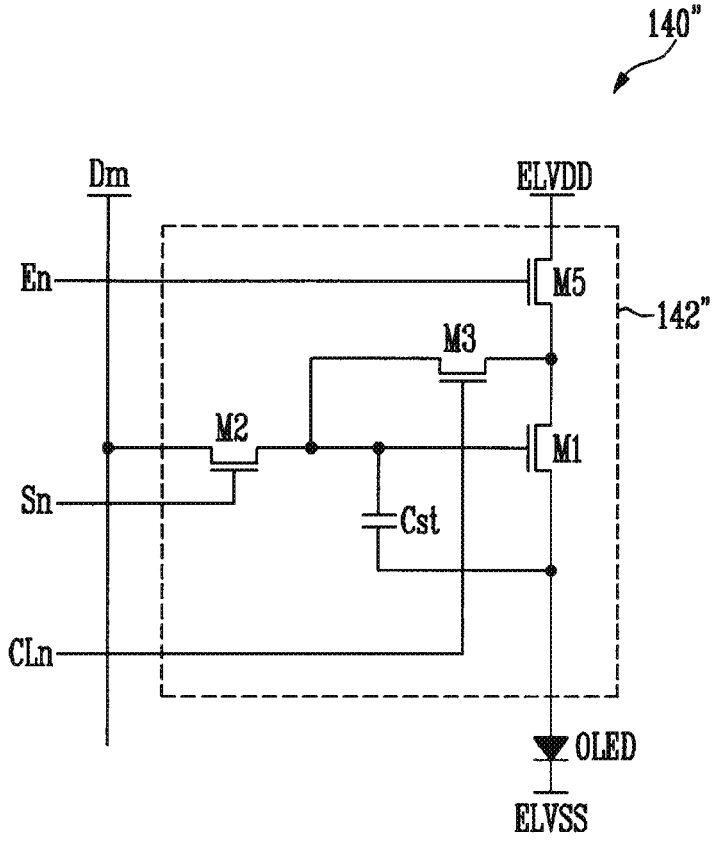
FIG. 6 is a circuit diagram illustrating a third embodiment of the pixel of FIG. 2.

FIG. 6 is a circuit diagram illustrating a pixel according to a third embodiment of the present invention. In the description of FIG. 6, like elements as FIG. 3 will be assigned with like reference numerals and their description will not be repeated.

Referring to FIG. 6, the pixel 140" includes an OLED and a pixel circuit 142" for controlling the amount of current supplied to the OLED. In comparison to the pixel circuit 142 as shown in FIG. 3, the pixel circuit 142" is identical except that the fourth transistor M4 is removed. The removed fourth transistor M4 is used to supply the voltage of the reference power source Vref for compensating the threshold voltage of the first transistor M1. In the pixel 142", the fourth transistor M4 is removed and the voltage of the reference power source Vref is supplied to the data line Dm to compensate the threshold voltage of the first transistor M1.

Figure 7:
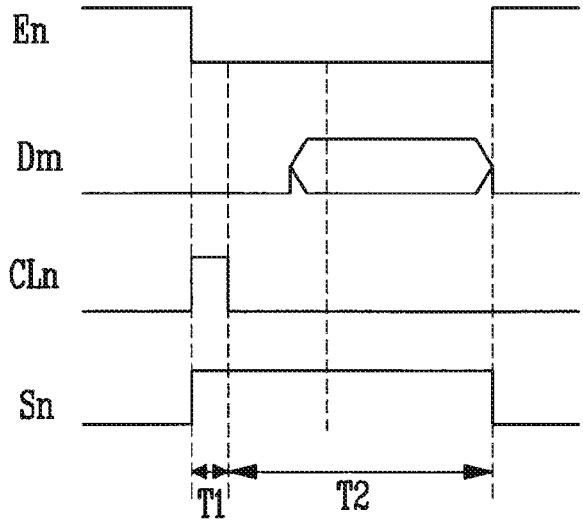
FIG. 7 is a waveform chart illustrating a driving method of the pixel of FIG. 6.

FIG. 7 is a waveform chart illustrating a driving method of the pixel of FIG. 6.

For convenience of description of FIG. 7, driving processes will be described for a first period T1 and a second period T2. During the first period T1, the control signal is supplied to the control line CLn, the scan signal is supplied to scan line Sn, the light emitting control signal is supplied to light emitting control line En, and the voltage of the reference power source Vref is supplied to the data line Dm. During the second period T2, the supply of the control signal to the control line CLn is stopped, the scan signal continues to be supplied to the scan line Sn, the light emitting control signal continues to be supplied to the light emitting control line En, and the data signal is supplied to the data line Dm.

Referring to FIG. 7, first, the light emitting control signal is supplied to the light emitting control line En, the control signal is supplied to the control line CLn, and the scan signal is supplied to the scan line Sn during the first period T1.

When the light emitting control signal is supplied to the light emitting control line En, the fifth transistor M5 is turned off. When the fifth transistor M5 is turned off, the first transistor M1 and the first power source ELVDD are electrically separated from each other.

When the control signal is supplied to the control line CLn, the third transistor M3 is turned on. When the third transistor M3 is turned on, the first transistor M1 is diode-connected.

When the scan signal is supplied to the scan line Sn, the second transistor M2 is turned on. When the second transistor M2 is turned on, the voltage of the reference power source Vref supplied to the data line Dm is supplied to the gate electrode of the first transistor M1 via the second transistor M2. Since the first transistor M1 is diode-connected, a voltage, in which the threshold voltage of the first transistor M1 is subtracted from the voltage of the reference power source Vref, is applied to the second electrode of the first transistor M1.

During the second period T2, the supply of the control signal to the control line CLn is stopped and the third transistor M3 is turned off. The data signal is supplied to the data line Dm during the second period T2.

The data signal supplied to the data line Dm during the second period T2 is supplied to the gate electrode of the first transistor M1 via the second transistor M2. In this case, a voltage between the gate electrode and the source electrode of the first transistor M1 is set by equation 1.

After the second period T2, the supply of the scan signal to the scan line Sn is stopped and the supply of the light emitting control signal to the light emitting control line En is stopped. When the supply of the scan signal to the scan line Sn is stopped, the second transistor M2 is turned off. When the supply of the light emitting control signal to the light emitting control line En is stopped, the fifth transistor M5 is turned on. In this case, the first transistor M1, as expressed by equation 2, supplies current independent of the threshold voltage of the first transistor M1 to the OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a first transistor for controlling an amount of current supplied to the organic light emitting diode;

a storage capacitor coupled between a gate electrode and a second electrode of the first transistor;

a second transistor coupled between the gate electrode of the first transistor and a data line, and configured to turn on when a scan signal is supplied to a scan line;

a fourth transistor coupled between a first electrode of the first transistor and a first power source, and configured to be off during a period when a voltage is charged to the storage capacitor; and a third transistor coupled between the gate electrode and the first electrode of the first transistor, and configured to be on for a part of a period when the fourth transistor is turned off.

2. The pixel as claimed in claim 1, wherein the second transistor and the third transistor are configured to turn on at a same time.

3. The pixel as claimed in claim 2, wherein the second transistor is configured to maintain a turn-on state for a time longer than that of the third transistor.

4. The pixel as claimed in claim 3, wherein the data line is configured to:

receive a voltage of a reference power source during a period when the second transistor and the third transistor are turned on at the same time; and receive a data signal for a period when the second transistor only maintains the turn-on state.

5. The pixel as claimed in claim 1, wherein the fourth transistor is configured to maintain a turn-off state for a period when the second transistor or the third transistor is turned on.

6. The pixel as claimed in claim 1, further comprising a fifth transistor coupled between the gate electrode of the first transistor and a reference power source, and configured to turn on and off concurrently with the third transistor.

7. The pixel as claimed in claim 6, wherein the second transistor is further configured to turn on after:

the third transistor and the fifth transistor are turned on, and a voltage corresponding to a threshold voltage of the first transistor is charged to the storage capacitor.

8. The pixel as claimed in claim 6, further comprising a sixth transistor coupled between the second electrode of the first transistor and the organic light emitting diode, and configured to turn on and off concurrently with the fourth transistor.

9. An organic light emitting display device comprising:

a scan driving unit for supplying scan signals to scan lines in a first direction, and for supplying light emitting control signals to light emitting control lines in the first direction;

a control line driving unit for supplying control signals to control lines in the first direction;

a data driving unit for supplying data signals to data lines in a second direction that crosses the first direction, in synchronization with the scan signals; and a pixel positioned at an ith (i is a natural number) line in the first direction and a jth (j is a natural number) line in the second direction, comprising:

an organic light emitting diode;

a first transistor for controlling the amount of current supplied to the organic light emitting diode;

a storage capacitor coupled between a gate electrode and a second electrode of the first transistor;

a second transistor coupled between the gate electrode of the first transistor and a jth data line of the data lines, and configured to turn on when a scan signal of the scan signals is supplied to an ith scan line of the scan lines;

a third transistor coupled between the gate electrode and a first electrode of the first transistor, and configured to turn on when a control signal of the control signals is supplied to an ith control line of the control lines; and a fourth transistor coupled between the first electrode of the first transistor and a first power source, and configured to:

turn off when a light emitting control signal of the light emitting control signals is supplied to an ith light emitting control line of the light emitting control lines; and turn on when the light emitting control signal is not supplied.

10. The organic light emitting display device as claimed in claim 9, wherein:

the scan signal is set to a wider width than the control signal, and the control signal and the scan signal are supplied at a same time.

11. The organic light emitting display device as claimed in claim 10, wherein the light emitting control signal overlaps the control signal and the scan signal.

12. The organic light emitting display device as claimed in claim 10, wherein the data driving unit is configured to:

supply a voltage of a reference power source to the jth data line for a period when the control signal is supplied; and supply a data signal of the data signals to the jth data line for a period when the control signal is not supplied and the scan signal is supplied.

13. The organic light emitting display device as claimed in claim 12, wherein the voltage of the reference power source is set to a voltage higher than a threshold voltage of the organic light emitting diode.

14. The organic light emitting display device as claimed in claim 9, further comprising a fifth transistor coupled between the gate electrode of the first transistor and a reference power source, and configured to turn on and off concurrently with the third transistor.

15. The organic light emitting display device as claimed in claim 14, wherein the scan signal is supplied after the control signal is supplied.

16. The organic light emitting display device as claimed in claim 15, wherein the light emitting control signal overlaps the control signal and the scan signal.

17. The organic light emitting display device as claimed in claim 14, further comprising a sixth transistor coupled between the second electrode of the first transistor and the organic light emitting diode, and configured to:

turn off when the light emitting control signal is supplied; and turn on when the light emitting control signal is not supplied.

* * * * *